US005189397A

United States Patent [19]

Watkins et al.

[11] Patent Number: 5,189,397

[45] Date of Patent: Feb. 23, 1993

[54] METHOD AND APPARATUS FOR DETERMINING THE MAGNITUDE OF A FIELD IN THE PRESENCE OF AN INTERFERING FIELD IN AN EAS SYSTEM

[75] Inventors: Harry E. Watkins, Boca Raton, Fla.; David L. Roberson, Forest, Va.

[73] Assignee: Sensormatic Electronics Corporation, Deerfield Beach, Fla.

[21] Appl. No.: 820,313

[22] Filed: Jan. 9, 1992

[51] Int. Cl.[5] ..... G08B 13/24

[52] U.S. Cl. ..... 340/572; 340/551

[58] Field of Search ..... 340/572, 551

[56] References Cited

U.S. PATENT DOCUMENTS 4,859,991 8/1989 Watkins et al. ..... 340/572

*Primary Examiner*—Glen R. Swann, III

*Attorney, Agent, or Firm*—Robin, Blecker, Daley & Driscoll

[57] ABSTRACT

A method and apparatus for determining the amplitude of a first magnetic field at a first fundamental frequency in a zone in which a second magnetic field is able to be present wherein first and second transmissions of a magnetic field at the fundamental frequency and different phases is carried out at different times, the field in the zone is detected for each transmission and the detected fields are processed to determine the magnitude of the first magnetic field.

33 Claims, 3 Drawing Sheets

METHOD AND APPARATUS FOR DETERMINING THE MAGNITUDE OF A FIELD IN THE PRESENCE OF AN INTERFERING FIELD IN AN EAS SYSTEM

BACKGROUND OF THE INVENTION

This invention relates generally to electronic article surveillance (EAS) systems and, more particularly, to an apparatus and method for detecting in an EAS system a field which is subject to interference from one or more other fields which may be generated by other EAS systems operating in close proximity.

One form of EAS system presently known detects the presence of magnetic type tags which ar attached to articles which are under surveillance. This type of system is disclosed in U.S. Pat. No. 4,859,991, assigned to the same assignee hereof, and includes a transmitter which projects a magnetic field at a fundamental frequency into a surveillance zone which is monitored by a receiver. When an article carrying a magnetic tag is placed in the surveillance zone, the tag generates harmonics of the fundamental frequency which are detected by the receiver. The receiver then activates various alarms, or other appropriate signals, to indicate the presence of the tag and, therefore, the article in the zone.

In this type of system, large metal objects placed in the surveillance zone can, in some instances, generate harmonics similar to those produced by the magnetic tag. This can result in an inadvertent activation of the system alarm. To prevent this, the system is adapted to distinguish between tags and large metal objects.

More particularly, the receiver of the system is made to sense the amplitude of the magnetic field at the fundamental frequency projected by the transmitter. A change in this amplitude is recognized by the system as indicating the presence of a large metal object in the surveillance zone. Accordingly, upon detection of such change, the system inhibits the initiation of the system alarm, thereby avoiding false alarms due to the large metal object.

In an EAS system, once the transmitter and receiver are fixed in location, the amplitude of the fundamental magnetic field, i.e., the field at the fundamental frequency, in the surveillance zone will not vary appreciably over time, unless a large metal object is passed through the zone. Therefore, a single measurement of the amplitude of this field at initial set-up can be used as a baseline or reference value for detection o large metal objects during subsequent operation. More specifically, during such operation, the amplitude of the field measured at the system receiver is compared against the baseline. When a difference greater than a predetermined amount is detected, the EAS system determines that a large metal object is in the surveillance zone. It, therefore, enters an inhibit mode, whereby alarms are suppressed.

The above procedure of using the received amplitude of the system fundamental for detecting the presence of large metal objects in the system surveillance zone has worked satisfactorily where only a sole or first EAS system is present. However, where a second EAS systems is in close proximity to the first, the detection process is degraded. In particular, in such case, the first system's receiver detects the fundamental magnetic field in the surveillance zone resulting from both its own as well as the second system's transmitter. Since these fields are a result of different systems, they generally will not be totally synchronized in frequency and phase if they are not connected together.

As a result, the amplitude of the received fundamental magnetic field established in the zone as a result of the first system will be caused to vary over time based on the fundamental in the zone caused by the transmitter of the second system. Even if the transmitted fields are synchronized in frequency and phase, the received fundamental resulting from the first system still changes based on the on/off state of the second system. The presence of the second system thus causes changes in the received first system fundamental similar to those attributable to large metal objects in the surveillance zone. It, therefore, becomes difficult to determine the presence of such objects based on the detected first system fundamental. It may even be necessary to inhibit the suppression system, thereby increasing the susceptibility of the EAS system to false alarms due to large metal objects.

It is therefore a object of the present invention to provide an apparatus and method for determining the amplitude of a first field in a zone in the presence of a second field in such zone.

It is a further object of the present invention to provide an apparatus and method for use in improving the ability of an EAS system to distinguish between a field in a surveillance zone established by the EAS system and another field in the zone established by a nearby system.

It is a further object of the present invention to utilize the method and apparatus of the preceding object to enable an EAS system to better sense large metal objects in the surveillance zone.

SUMMARY OF THE INVENTION

In accordance with the principles of the present invention, the above and other objectives are realized in an apparatus and method in which the amplitude of a first field at a first fundamental frequency established in a zone is to be determined in the presence of a second field in the zone. Means is provided to enable a first transmission in the zone of a field at the first fundamental frequency, a first amplitude and a first phase to establish the first field at a first time. Means is further provided to enable first detection of the field in the zone as a result of the first transmission.

Means is then provided to enable a second transmission of a field in the zone at the first fundamental frequency, first amplitude and a second phase at a second time. Further means enables second detection of the field in the zone as a result or the second transmission.

Thereafter, processing of the fields detected in the first and second detections is enabled to ascertain from these fields the amplitude of the first field in the zone. Such processing uses the amplitudes X and Y of the detected fields and the phase angles $\Theta_1$ and $\Theta_2$ of the detected fields and determines the amplitude or magnitude $|A|$ of the first field A in accordance with the following expression:

$$|a| = [SQRT[X^2 + Y^2 - 2XY\ COS\ (\Theta_2 - \Theta_1)]]/2$$

In the embodiment of the invention to be disclosed hereinafter, the method and apparatus of the invention are incorporated into the control and processing means of an EAS system. The transmitter and receiver of the system are thus controlled to effect the first and second transmissions and detections during initial start-up of the system. Subsequent processing permits the magnitude of the fundamental field in the zone of the EAS system to be determined. This value of the field at start-up then serves as a reference value for the EAS system in assessing the presence of large metal objects during subsequent operation.

By providing further enabling means in the method and apparatus of the invention, for subsequent first and second transmissions and corresponding subsequent first and second detections, corresponding processing can be carried out to determine the magnitude of the amplitude of the fundamental field in the zone at one or more subsequent times during operation of the system. Each subsequent value can then be compared with the initial value determined during start-up to assess any change and whether such change is indicative of a large metal object in the zone of the first system at the corresponding subsequent time.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
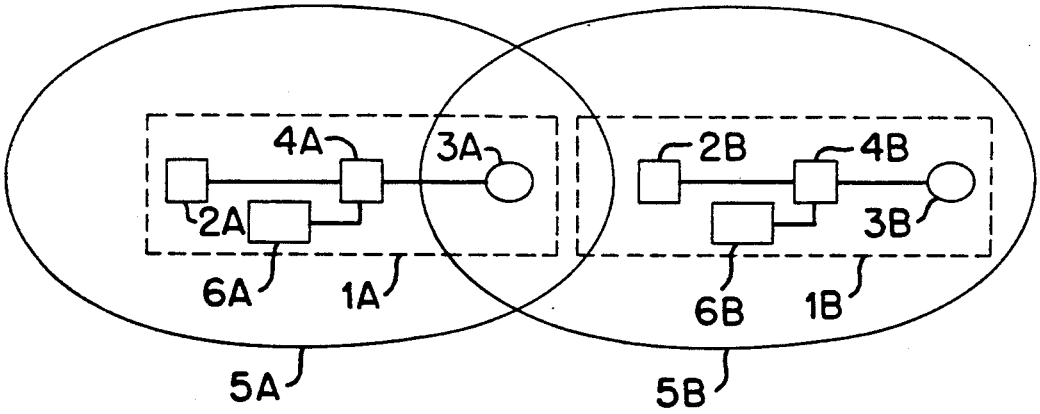
FIG. 1 shows two EAS systems located in close proximity to one another.

FIG. 1 illustrates first and second EAS systems IA and IB located in close proximity to one another. These systems can be of the type disclosed in the aforementioned '991 patent, the teachings of which are incorporated herein by reference. More particularly, the first EAS system IA comprises a transmitter, 2A, a receiver 3A and a control and processing unit 4A. Under control of the unit 4A, the transmitter 2A projects a first magnetic field at a first fundamental frequency and first amplitude into a first surveillance zone 5A which is monitored by the first receiver 3A. Similarly, the second EAS system IB comprises a transmitter 2B, a receiver 3B and a control and processing unit 4B. Under control of the unit 4B, the second transmitter 2B likewise projects a second magnetic field at a second fundamental frequency and second amplitude into a second surveillance zone 5B which is monitored by the second receiver 3B.

Magnetic tags and some types of large metal objects when positioned within the first surveillance zone 5A, cause fields at harmonics of the first fundamental frequency to be established. These harmonics are then received by the first receiver 3A and processed in the control and processing unit 4A. If the harmonics satisfy certain criteria, the control system will then activate an alarm 6A.

Since the harmonics generated by both magnetic tags and large metal objects may result in an alarm and since it is desired that the alarm be activated only for magnetic tags, the EAS system IA is further adapted to suppress the alarm 7A in the event of large metal objects in the zone. The EAS system IA accomplishes this by sensing changes in the amplitude or magnitude of the field at the first fundamental frequency, i.e., the first fundamental field, received by its receiver 3A. However, due to the close proximity of the first and second EAS systems IA and IB, the receiver 3A falls within the boundary of both the first and second surveillance zones 5A and 5B. It, therefore, receives a second field at the second fundamental frequency, i.e., the second fundamental field, established by the system 1B.

When the first and second fundamental frequencies are closely related, the aforesaid second fundamental field received by the receiver 3A alters or changes the received first fundamental field. As a result, monitoring the changes in the amplitude of the first fundamental field to sense the presense of large metal objects in the zone 5A can no longer be a reliable procedure, unless the interference effects of the second fundamental field can be removed from the received field.

Figure 2:
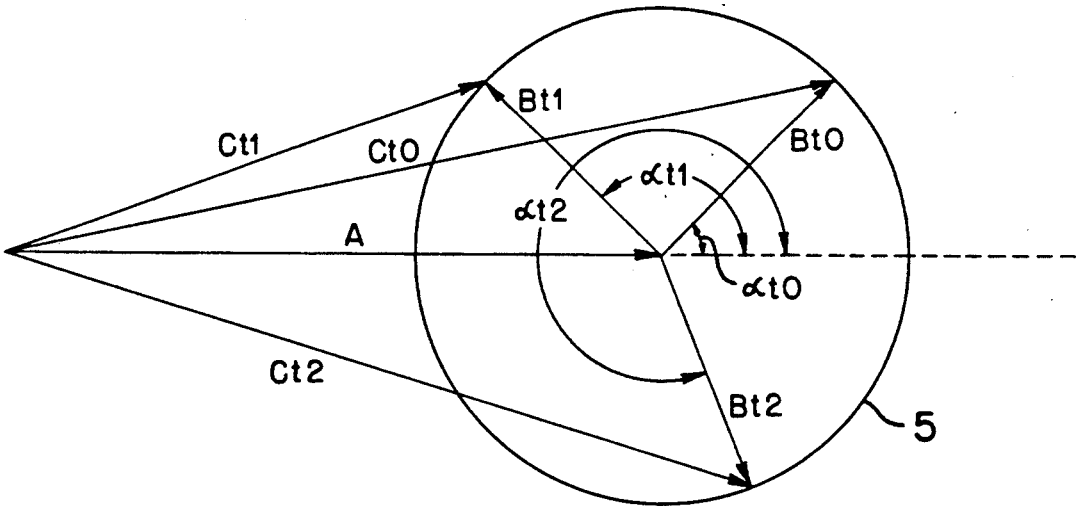
FIG. 2 illustrates the received field at the first EAS system as composed of a fundamental field established by the first EAS system and a fundamental field established by the second EAS system.

FIG. 2 shows the above interference effects in greater detail. More particularly, FIG. 2 illustrates in vector form the combined first and second fundamental fields received by the receiver 3A. Since, as above-noted, these fields are closely matched, but not identical, in frequency there is a phase angle $\alpha$ between the first and second fields which changes slowly over time. This causes, the amplitude of the combined field to also change slowly over time.

In FIG. 2, vector A represents the first fundamental field, i.e., that at the first fundamental frequency, received by the receiver 3A. The phase angle of vector A is shown as 0°, since the first field is in phase with its generating field established by the transmitter 2A. Vector $B_{f0}$ represents the second field at the second fundamental frequency, and due to the lack of synchronization between the second transmitter 2B and the first transmitter 2A, it is shown at some initial phase angle $\alpha_{f0}$ with respect to vector A. Accordingly, the amplitude of the combined received field at a time $t_0$ is the vector sum of vector A and vector $B_{f0}$, which is shown as vector $C_{f0}$.

At a later time $t_1$, vector $B_{f1}$ represents the contribution of the second fundamental field and, as above-noted, due to the difference between the first and second fundamental frequencies, the phase angle of the second field changes to $\alpha_{f1}$. The amplitude of the received field at the receiver 3A thus also changes to the magnitude of $C_{f1}$. At a still later time $t_2$, the phase angle of the vector $B_{f2}$ changes to $\alpha_{f2}$ and, therefore, the amplitude of received field changes to the magnitude of $C_{f2}$.

As the phase angle of the second fundamental field changes with respect to the first fundamental field, the vector of the received field is thus caused to rotate in the circle 5 as shown in FIG. 2. The received field at the reciever 3A therefore constantly changes over time as a result of the second field. Accordingly, as above-indicated, changes to the received field can no longer be reliably used to sense the presence of large metal objects in the surveillance zone 5A. A similar situation will occur at the receiver 3B in zone 5B due to the field from the transmitter 2A in the zone 5A.

In accordance with the principles of the present invention, the EAS system IA is modified or adapted to include a method and apparatus which permits the first fundamental field to be substantially extracted from the field at the receiver 3A so that its amplitude or magnitude $|A|$ can be ascertained substantially devoid of any interference from the second fundamental field. In this way, since the magnitude of the first field is ascertainable without interference, changes in this magnitude will be indicative of the presence of large metal objects in the zone 5A and, thus, these changes can again be reliably used by the system IA to suppress its alarm 7A during such presence.

In accordance with the principles of the present invention, the ability to extract the first fundamental field from the received field is achieved by suitable control of the operation of the system 1A. In particular, when the magnitude $|A|$ of the first fundamental field in the zone is to be ascertained, a field at the first fundamental frequency and a first amplitude is transmitted into the zone 5A at first and second times and at first and second different phases, respectively. The first and second fields detected at the receiver 3A as a result of these two transmissions are then suitably processed by the control and processing system 4A to provide the desired magnitude $|A|$ of the first fundamental field.

By performing the aforesaid transmissions, detections and processing upon initial start-up of the EAS system IA, an initial or reference value can be first obtained for the magnitude $|A|$ of the first fundamental field. Thereafter, the procedure can be performed during each operating cycle of the system to determine the magnitude $|A|$ at that time. This magnitude can then be compared with the initial magnitude and if the difference exceeds a preselected value, a metal object is determined to be present in the zone 5A and the system alarm is suppressed.

Figure 3:
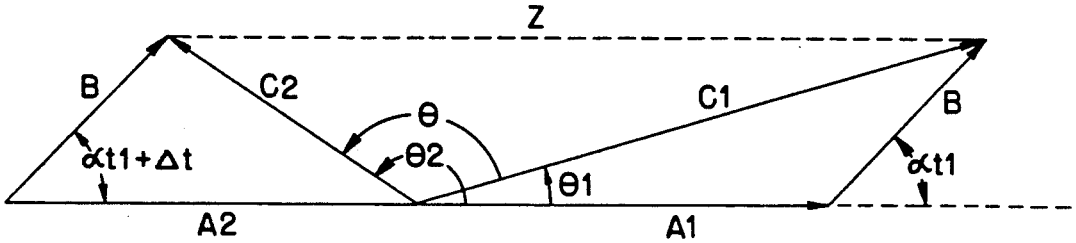
FIG. 3 illustrates the received field at the first EAS system of FIG. 1 for transmitted fields of the first EAS system shifted in phase by 180°.

FIG. 3 illustrates the above-discussed procedure carried our by the control and processing system 4A of EAS system 1A in greater detail. Vector $C_1$ represents the field at receiver 3A when the first transmitter projects a field at a first phase, shown as 0°. Vector $C_2$, in turn, represents the received field when the first transmitter 2A projects a field at a second phase, shown as 180° in the present illustrative case. If the magnitude of $C_1$ is X, and the magnitude of $C_2$ is Y, then as can be seen from FIG. 3, $$A_1 = |A| \text{ at } 0°, \; A_2 = |A| \text{ at } 180°,$$

$$C_1 = X \text{ at } \Theta_1, \; C_2 = Y \text{ at } \Theta_2,$$

and $$\Theta = \Theta_2 - \Theta_1.$$

Since X, Y, and 8 are known, and the dashed line Z forms a triangle with $C_1$ and $C_2$, then the magnitude of Z is determined from the expression $$|Z| = SQRT[X^2 + Y^2 - 2XYCos(\Theta)].$$

Since $$|Z| = |A_1| + |A_2|,$$

and $$|A_1| = |A_2| = |A|$$

then $$|A| = |Z|/2,$$

or $$|A| = [SQRT[X^2 + Y^2 - 2XYCos(\Theta)]/2.$$

Thus, by the control and processing system 4A controlling the system 1A to make the first and second projections at the different times and phases, and by the control and processing system 4A further controlling the system 1A to also make the subsequent first and second detections of the received signals resulting from these projections and the processing of the detected fields in accordance with the above expression, the magnitude of the first field $|A|$ can be obtained absent the effects of the second field.

It should be noted that the above processing assumes that the phase angle of the second fundamental field in the period between the first and second times covering the measurements $C_1$ and $C_2$ has not change substantially. Since the phase angle between the first and second fundamental fields changes slowly (a typical example might be 3° per second), this can be assured by making the time period between transmissions relatively small, e.g., 300 msec.

It should be further noted that while the present example in FIG. 3 shows the second phase as 180°, other phases could also have been used.

As was indicated above, the EAS system IA carries out the above procedure at initial set up to obtain a baseline or reference magnitude for the first fundamental field. Thereafter, the procedure is used during each measurement cycle to determine the magnitude of the first fundamental field at that time. This magnitude is then compared against the baseline magnitude, and when a difference greater than a predetermined amount is detected the EAS system enters its inhibiting mode, whereby alarm initiations are suppressed.

Figure 4:
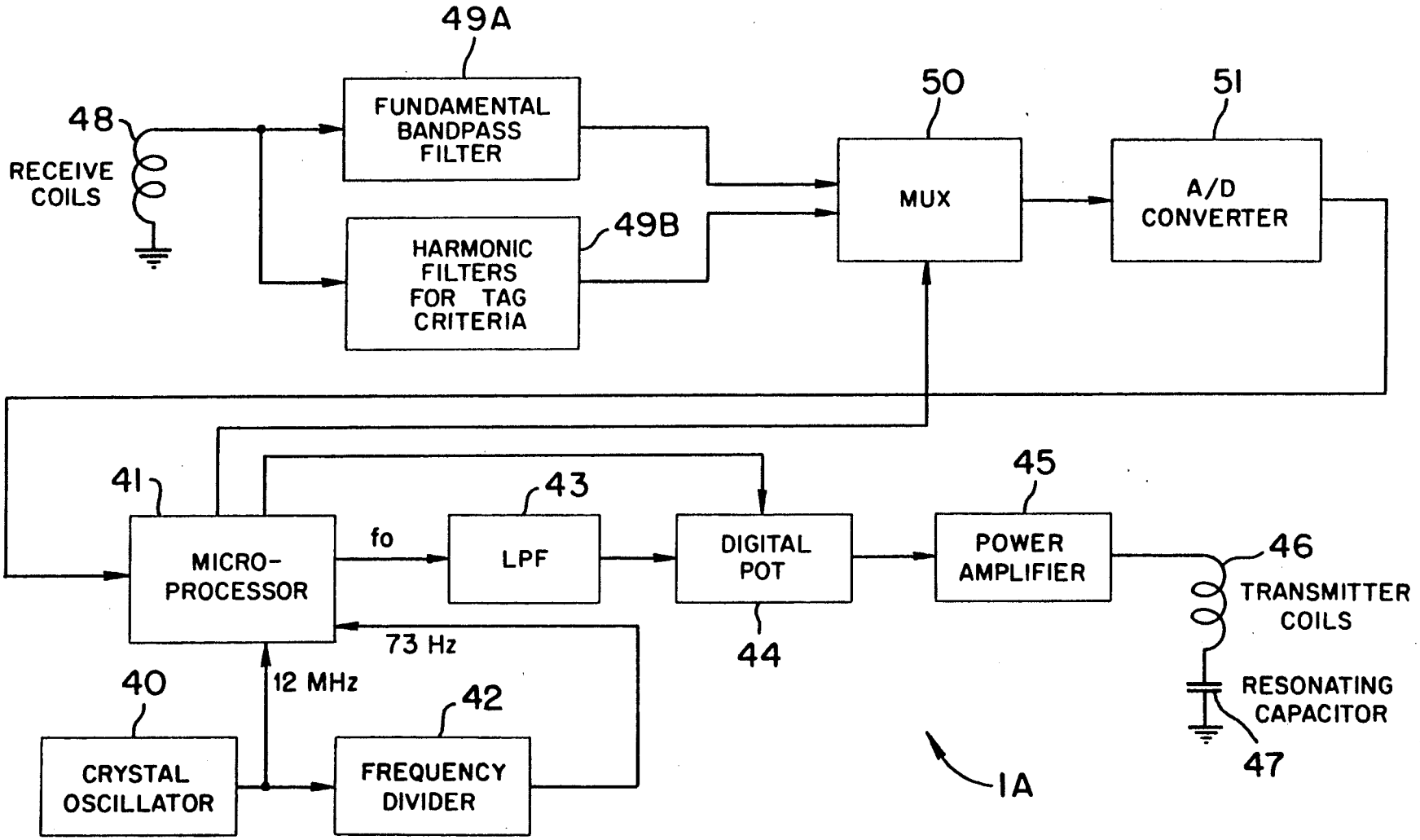
FIG. 4 shows a more detailed block diagram of certain components of the first EAS system of FIG. 1.

FIG. 4 shows in block diagram form, additional details of certain components of the first EAS system IA. A crystal oscillator 40 provides a clock signal (shown as a 12 MHz signal) for a microprocessor 41 and a frequency divider 42. The microprocessor 41 generates from the clock signal a square wave at the first fundamental frequency $f_o$. The latter signal is synchronized in frequency, but not in phase to the divider output (shown as a 73 Hz signal). This allows the microprocessor 41 to adjust the phase of output square wave signal and thus the phase of the transmitter being driven by the signal.

More particularly, the square wave signal at frequency $f_o$ is processed through a low pass filter 43 to generate a smooth sine wave. The sine wave signal is then passed through a digital pot 44 which is used to adjust the transmit current level. A power amplifier 45 follows the digital pot 44 and drives the transmitter coils 46 which form a resonant LC circuit with a resonating capacitor 47. The coils 47 produce the transmit field at the first fundamental frequency $f_o$.

The receiver coils 48 sense the field in the zone 5A. This field includes harmonics generated by the tags or large metal objects in the zone 5A, as well as the first and second fundamental fields. A fundamental bandpass filter 49A and a harmonic filter 49B isolate the harmonics from the first and second signals. The isolated signals are then passed to a multiplexer 50 controlled by the microprocessor 41. The microprocessor 41 can examine any signal by setting the appropriate multiplexer address, and then measuring the signal through the A/D converter 51.

Figure 5:
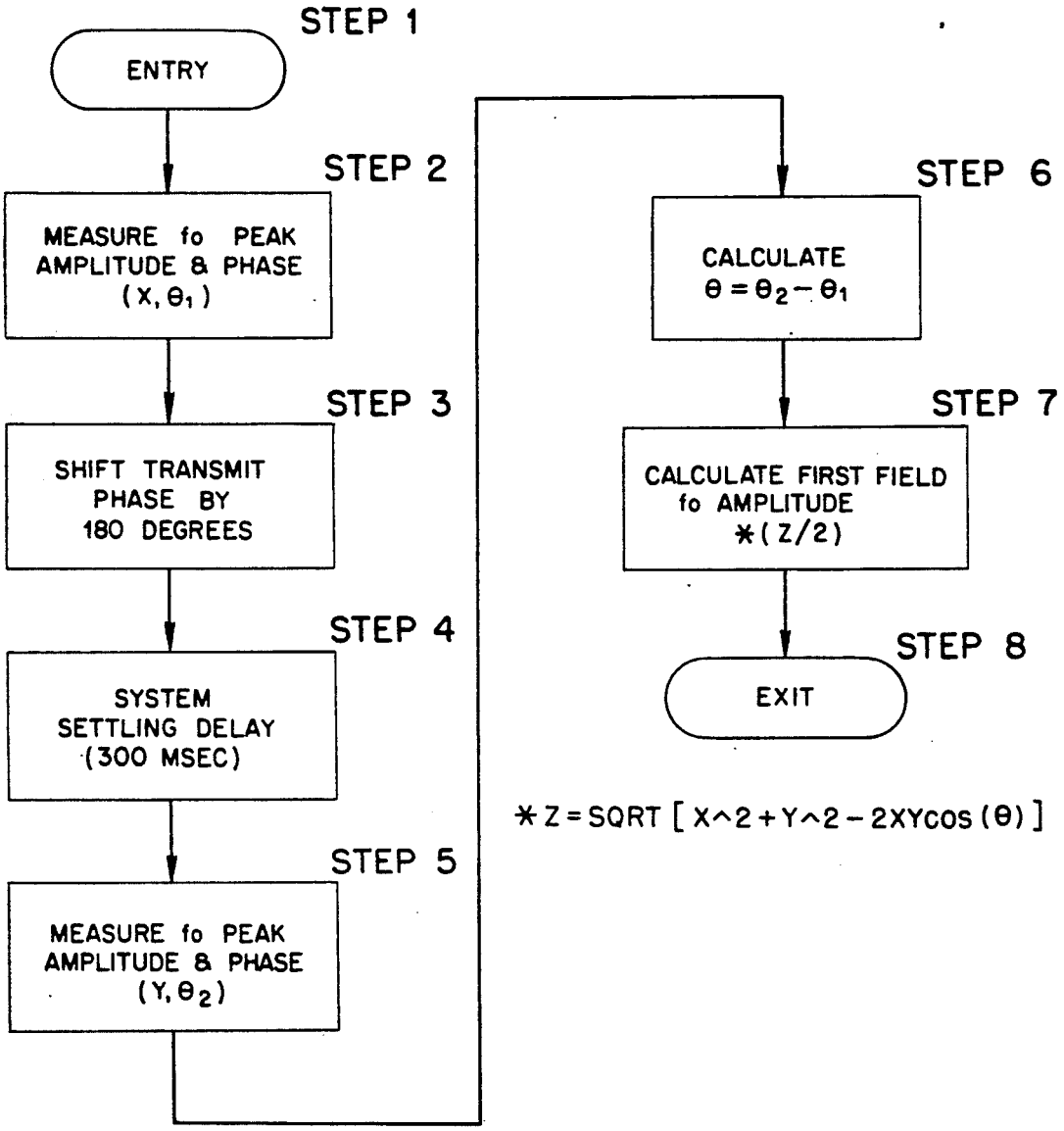
FIG. 5 is a flow chart illustrating the operation of the first EAS system of FIG. 4 for determining the magnitude of the fundamental field of such first system.

FIG. 5 shows a flow chart of the procedure invoked by the microprocessor 41 and implemented in software to determine the magnitude of the first fundamental field. This procedure is as follows.

STEP 1 —ENTRY— Entry point of the routine. Sets the multiplexer address so that the output of the fundamental bandpass filter 49A is routed to the A/D converter 51.

STEP 2 —MEASURE PEAK AMPLITUDE & PHASE ($X$, $\Theta_1$)— Determine the peak amplitude or magnitude $|X|$ by sampling the incoming waveform several times over one cycle of 73 Hz. The phase $\Theta_1$ of the received signal is determined by comparing the incoming signal to the phase of the 73 Hz square wave produced by the frequency divider 42. The values for $X$ and $\Theta_1$ are then stored in a memory.

STEP 3 —SHIFT TRANSMIT PHASE BY 180°— The transmit phase of the current in the transmitter coils 46 is shifted by 180°. This is accomplished by inverting the output waveform at the fundamental frequency $f_o$ which is supplied from the microprocessor 41 to the low pass filter 43.

STEP 4 —SYSTEM SETTLING DELAY (300 msec.)— The output of the power amplifier 45 drives the transmitter coils 46 and the resonating capacitor 47. However, due to the nature of the low pass filter 43, the inductive nature of the transmitter coil 46 and the capacitive nature of the resonating capacitor 47, the shift in phase of STEP 3 does not result in an instantaneous shift in the transmitted phase. A delay is provided, e.g., a delay of 300 msec, to ensure that the transmission has settled.

STEP 5 MEASURE PEAK AMPLITUDE & PHASE ($Y$, $\Theta_2$)— The second measurement of the peak magnitude $Y$ and the phase $\Theta_2$ is performed in a manner similar to STEP 2.

STEP 6 —CALCULATE $\Theta$— determine 8 by subtracting $\Theta_1$ from $\Theta_2$.

STEP 7 —CALCULATE FIRST FIELD AMPLITUDE— Determine the amplitude of the first field by performing the following mathematical operation; $[SQRT[X^2+Y^2-2XY\cos(\Theta)]]/2$.

STEP 8 —EXIT— Exit this routine

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is

1. Apparatus for use in determining the fundamental amplitude of a first magnetic field at a first fundamental frequency in a zone in which a second magnetic field is able to be present comprising:

means for enabling first transmission of a magnetic field at said fundamental frequency, a first amplitude and a first phase into said zone to establish said first magnetic field at a first time;

means for enabling first detection of the magnetic field in said zone as a result of said first transmission;

means for enabling second transmission of a magnetic field at said fundamental frequency, said first amplitude and a second phase different from said first phase into said zone to establish said first magnetic field at a second time;

means for enabling second detection of the magnetic field in said zone as a result of said second transmission;

and means for enabling first processing of the magnetic fields detected as a result of said first and second detections to determine the fundamental amplitude of said first magnetic field.

2. Apparatus in accordance with claim 1 wherein:

said first detection includes detecting the amplitude $X$ and the phase angle $\Theta_1$ of the magnetic field being detected;

said second detection includes detecting the amplitude $Y$ and the phase angle $\Theta_2$ of the magnetic field being detected;

and said first processing of said detected magnetic fields includes determining said fundamental amplitude $|A|$ of said first magnetic field $A$ in accordance with the expression $$|A|=[SQRT[X^2+Y^2-2XY\,COS\,(\Theta_2-\Theta_1)]\,/2.$$

3. Apparatus in accordance with claim 2 further comprising:

means for enabling one or more first subsequent transmissions of a magnetic field at said fundamental frequency said first amplitude and first phase to establish said first magnetic field in said zone at one or more first subsequent times;

means for enabling first subsequent detections of the magnetic field in said zone as a result of said one or more first subsequent transmissions;

means for enabling one or more second subsequent transmissions of a magnetic field at said fundamental frequency said first amplitude and said second phase into said zone to establish said first magnetic field at one or more second subsequent times each following one of said first subsequent times;

means for enabling second subsequent detections in said zone as a result of said one or more second subsequent transmissions; and means for enabling subsequent processing of the magnetic fields detected as a result of said first subsequent detections and said second subsequent detections to determine subsequent fundamental amplitudes of said first magnetic field, each said subsequent processing using first and second subsequent detections to determine a subsequent fundamental amplitude of said first magnetic field.

4. Apparatus in accordance with claim 3 wherein:

each said first subsequent detection includes detecting the amplitude $X_s$ and the phase angle $\Theta_{1s}$ of the magnetic field being detected;

each said second subsequent detection includes detecting the amplitude $Y_s$ and the phase angle $\Theta_{2s}$ of the magnetic field being detected;

and each said subsequent processing includes determining the subsequent fundamental amplitude $|A|$ of said first magnetic field $A$ from the detected amplitude and phase angles of the magnetic fields of first and second subsequent detections in accordance with the following expression:

$$|A| = [SQRT[X_s^2 + Y_s^2 - 2X_sY_s COS(\Theta_{2s} - \Theta_{1s})]/2.$$

5. Apparatus in accordance with claim 4 further comprising:

means for enabling each of said subsequent amplitudes to be compared to said first amplitude to determine any difference.

6. Apparatus in accordance with claim 5 further comprising:

means for disabling an operation in said apparatus when said determined difference exceeds a preselected value.

7. Apparatus in accordance with claim 6 wherein:

said operation includes suppressing an alarm.

8. Apparatus in accordance with claim 4 wherein:

said first and second times and each first subsequent time and the immediately following second subsequent time are such that over the period between the first and second times and over the period between each first subsequent time and the immediately following second subsequent time the phase angle of said second magnetic field when in said zone changes a relatively small amount.

9. Apparatus in accordance with claim 8 wherein:

said period is equal to or less than about 1 second and said phase angle amount is equal to or less than about 5°.

10. Apparatus in accordance with claim 8 wherein:

the frequency of said second field is equal or close to said first fundamental frequency.

11. Apparatus in accordance with claim 2 wherein:

said first and second times are such that over the period between said first and second times the phase angle of said second magnetic field when in said zone changes a relatively small amount.

12. Apparatus in accordance with claim 11 wherein:

said period is equal to or less than about 1 second and said phase angle amount is equal to or less than about 5°.

13. Apparatus in accordance with claim 11 wherein:

the frequency of said second field is equal or close to said first fundamental frequency.

14. An electronic article surveillance system for use in detecting articles in a surveillance zone in which a first magnetic field at a first fundamental frequency is established by said article surveillance system and in which a second magnetic field is able to be present, said surveillance system comprising:

a transmitter;

a receiver;

and control and processing means including: means for enabling first transmission into said zone by said transmitter of a magnetic field at said first fundamental frequency, a first amplitude and a first phase to establish said first magnetic field at a first time; means for enabling first detection of the magnetic field in said zone received by said receiver as a result of said first transmission; means for enabling second transmission by said transmitter of a magnetic field at said first fundamental frequency, said first amplitude and a second phase different from said first phase into said zone to establish said first magnetic field at a second time; and means for enabling first processing of the magnetic fields detected as a result of said first and second detections to determine the fundamental amplitude of said first magnetic field.

15. An electronic article surveillance system in accordance with claim 14 wherein:

said first detection includes detecting the amplitude X and the phase angle $\Theta_1$ of the magnetic field being detected;

said second detection includes detecting the amplitude Y and the phase angle $\Theta_2$ of the magnetic field being detected;

and said first processing of said detected magnetic fields includes determining the fundamental amplitude A of said first magnetic magnitude field A in accordance with the expression $$|A| = [SQRT[X^2 + Y^2 - 2XY COS(\Theta_2 - \Theta_1)]]/2.$$

16. An electronic article surveillance system in accordance with claim 15 wherein:

said control and processing means further includes: means for enabling one or more first subsequent transmissions or a magnetic field at said fundamental frequency, said first amplitude and first phase to establish said first magnetic field in said zone at one or more first subsequent times; means for enabling first subsequent detections of the magnetic field in said zone as a result of said one or more first subsequent transmissions; means for enabling one or more second subsequent transmissions of a magnetic field at said fundamental frequency, said first amplitude and said second phase into said zone to establish said first magnetic field at one or more second subsequent times each following one of said first subsequent times; means for enabling second subsequent detections in said zone as a result of said one or more second subsequent transmissions; and means for enabling subsequent processing of the magnetic fields detected as a result of said first subsequent detections and said second subsequent detections to determine subsequent fundamental amplitudes of said first magnetic field, each said subsequent processing using first and second subsequent detections to determine a subsequent fundamental amplitude of said first magnetic field.

17. An electronic article surveillance system in accordance with claim 16 wherein:

each said first subsequent detection includes detecting the amplitude $X_s$ and the phase angle $\Theta_{1s}$ of the magnetic field being detected;

each said second subsequent detection includes detecting the amplitude $Y_s$ and the phase angle $\Theta_{2s}$ of the . magnetic field being detected;

and each said subsequent processing includes determining the subsequent fundamental amplitude |A| of said first magnetic field A from the detected amplitude and phase angles of the magnetic fields of first and second subsequent detections in accordance with the following expression:

$$|A| = [SQRT[X_s^2 + Y_s^2 - 2X_sY_s COS(\Theta_{2s} - \Theta_{1s})]]/2.$$

18. An electronic article surveillance system in accordance with claim 17 wherein:

said control and processing means further includes: means for enabling each of said subsequent amplitudes to be compared to said first amplitude to determine any difference.

19. An electronic article surveillance system in accordance with claim 18 wherein:

said control and processing means further includes means for disabling an operation in said system when said determined difference exceeds a preselected value.

20. An electronic article surveillance system in accordance with claim 19 wherein:

said operation includes suppressing an alarm.

21. An electronic article surveillance system in accordance with claim 17 wherein:

said first and second times and each first subsequent time and the immediately following second subsequent time are such that over the period between the first and second times and over the period between each first subsequent time and the immediately following second subsequent time the phase angle of said second magnetic field when in said zone changes a relatively small amount.

22. An article surveillance system in accordance with claim 21 wherein:

said period is equal to or less than about 1 second and said phase angle amount is equal to or less than about 5°.

23. An article surveillance system in accordance with claim 21 wherein:

the frequency of said second field is equal or close to said first fundamental frequency.

24. A method for use in determining the fundamental amplitude of a first magnetic field at a first fundamental frequency in a zone in which a second magnetic field is able to be present comprising:

enabling first transmission of a magnetic field at said fundamental frequency, a first amplitude and a first phase into said zone to establish said first magnetic field at a first time;

enabling first detection of the magnetic field in said zone as a result of said first transmission;

enabling second transmission of a magnetic field at said fundamental frequency, said first amplitude and a second phase different from said first phase into said zone to establish said first magnetic field at a second time;

enabling second detection of the magnetic field in said zone as a result of said second transmission;

and enabling first processing of the magnetic fields detected as a result of said first and second detections to determine the fundamental amplitude of said first magnetic field.

25. A method in accordance with claim 24 wherein:

said first detection includes detecting the amplitude X and the phase angle $\Theta_1$ of the magnetic field being detected;

said second detection includes detecting the amplitude Y and the phase angle $\Theta_2$ of the magnetic field being detected;

and said first processing of said detected magnetic fields includes determining said fundamental amplitude $|A|$ of said first magnetic field A in accordance with the expression $$|A| = [SQRT[X^2 + Y^2 - 2XY\,COS\,(\Theta_2 - \Theta_1)]]/2.$$

26. A method in accordance with claim 25 further comprising:

enabling one or more first subsequent transmissions of a magnetic field at said fundamental frequency, said first amplitude and first phase to establish said first magnetic field in said zone at one or more first subsequent times;

enabling first subsequent detections of the magnetic field in said zone as a result of said one or more first subsequent transmissions;

enabling one or more second subsequent transmissions of a magnetic field at said fundamental frequency, said first amplitude and said second phase into said zone to establish said first magnetic field at one or more second subsequent times each following one of said first subsequent times;

enabling second subsequent detections in said zone as a result of said one or more second subsequent transmissions; and enabling subsequent processing of the magnetic fields detected as a result of said first subsequent detections and said second subsequent detections to determine subsequent fundamental amplitudes of said first magnetic field, each said subsequent processing using first and second subsequent detections to determine a subsequent fundamental amplitude of said first magnetic field.

27. A method in accordance with claim 26 wherein:

each said first subsequent detection includes detecting the amplitude $X_s$ and the phase angle $\Theta_{1s}$ of the magnetic field being detected;

each said second subsequent detection includes detecting the amplitude $Y_s$ and the phase angle $\Theta_{2s}$ of the magnetic field being detected;

and each said subsequent processing includes determining the subsequent fundamental amplitude $|A|$ of said first magnetic field A from the detected amplitude and phase angles of the magnetic fields of corresponding first and second subsequent detections in accordance with the following expression:

$$[|A| = [SQRT[X_s^2 + Y_s^2 - 2X_sY_s\,COS\,(\Theta_{2s} - \Theta_{1s})]]/2.$$

28. A method in accordance with claim 27 further comprising:

enabling each of said subsequent amplitudes to be compared to said first amplitude to determine any difference.

29. A method in accordance with claim 28 further comprising:

disabling an operation in said apparatus when said determined difference exceeds a preselected value.

30. A method in accordance with claim 29 wherein:

said operation includes suppressing an alarm.

31. A method in accordance with claim 27 wherein:

said first and second times and each first subsequent time and the immediately following second subsequent time are such that over the period between the first and second times and over the period between each first subsequent time and the corresponding second subsequent time the phase angle of said second magnetic field when in said zone changes a relatively small amount.

32. A method in accordance with claim 31 wherein:

said period is equal to or less than about 1 second and said amount is equal to or less than about 5°.

33. A method in accordance with claim 32 wherein:

the frequency of said second field is equal or close to said first fundamental frequency.

* * * * *

UNITED STATES PATENT AND TRADEMARK OFFICE

CERTIFICATE OF CORRECTION

PATENT NO. : 5,189,397

DATED : February 23, 1993

INVENTOR(S) : Harry E. Watkins, et al.

It is certified that error appears in the above-identified patent and that said Letters Patent is hereby corrected as shown below:

| | |
|---|---|
| Col. 1, line 15 | Change "ar" to -- are -- |
| Col. 1, line 50 | Change "o" to -- of -- |
| Col. 4, line 21 | Change "presense" to -- presence -- |
| Col. 6, line 14 | After "]" insert -- ] -- |
| Col. 8, line 30 | After "]" insert -- ] -- |
| Col. 9, line 5 | After "]" insert -- ] -- |
| Col. 10, line 3 | Change "surviellance" to -- surveillance -- |
| Col. 10, line 23 | Change "or" to -- of -- |
| Col. 10, line 53 | Delete "⊙" |
| Col. 12, line 39 | Delete "[" first occurrence |

Signed and Sealed this

Sixteenth Day of November, 1993

*Attest:*

*Attesting Officer*

BRUCE LEHMAN

*Commissioner of Patents and Trademarks*